United States Patent [19]

Kroon et al.

[11] 4,255,241

[45] Mar. 10, 1981

[54] CATHODIC PROTECTION APPARATUS AND METHOD FOR STEEL REINFORCED CONCRETE STRUCTURES

[76] Inventors: David H. Kroon, 300 E. Roberts La., Wood Dale, Ill. 60191; James B. Bushman, 6395 Kennard Rd.; Joseph W. Rog, 2951 Plum Creek Pkwy., both of Medina, Ohio 44256

[21] Appl. No.: 37,632

[22] Filed: May 10, 1979

[51] Int. Cl.[3] ..... C23F 13/00

[52] U.S. Cl. ..... 204/147; 204/196

[58] Field of Search ..... 204/196, 147

[56] References Cited

U.S. PATENT DOCUMENTS

| | | | |
|---|---|---|---|
| 3,019,177 | 1/1962 | Anderson | 204/196 |
| 3,133,872 | 5/1964 | Miller et al. | 204/196 |
| 3,489,668 | 1/1970 | Anton et al. | 204/294 |
| 3,904,245 | 9/1975 | Clarke | 404/90 |

FOREIGN PATENT DOCUMENTS

| | | | |
|---|---|---|---|
| 104493 | 5/1966 | Denmark | 204/196 |

*Primary Examiner*—G. L. Kaplan

*Attorney, Agent, or Firm*—Jones, Thomas & Askew

[57] ABSTRACT

A cathodic protection system and method for steel reinforcement in concrete structures such as bridge decks, parking garage decks and highways utilizes platinized niobium or like metal wire anodes strategically positioned adjacent the concrete in a matrix of conductive carbonaceous material. The anode and matrix are preferably positioned in slots saw cut in the concrete surface avoiding the disposition of a conductive and wear resistant surface overlay which is not only expensive but which may exceed the design limitations of the structure. An impressed protective cathodic protection current is provided between the anodes and the steel of the structure. At places where the anode crosses in close proximity to reinforcing steel which may be exposed by the slot, or at places where cathodic protection current is not desired, a plastic sleeve may be placed over the anode. The anode may be connected directly to a current source or it may be spliced to an insulated copper lead wire and be brought down through the deck of the structure to be connected to the rectifier beneath the deck. Although more than one anode may be connected to any single rectifier circuit, it is preferred to have as many individual circuits as practicable to assist in analyzing the system performance with either permanently installed reference electrodes or portable reference electrodes.

34 Claims, 10 Drawing Figures

CATHODIC PROTECTION APPARATUS AND METHOD FOR STEEL REINFORCED CONCRETE STRUCTURES

This invention relates generally as indicated to a cathodic protection apparatus and method for steel reinforced concrete structures and more particularly to cathodic protection inhibiting metal corrosion in a wide variety of reinforced concrete structures such as bridge decks, garage decks, highways, and the like.

BACKGROUND OF THE INVENTION

The corrosion of steel in reinforced concrete structures, particularly in northern latitudes where de-icing salts are widely employed, is a constant and increasing problem. The primary cause of such corrosion is the contamination of the concrete by chloride ions resulting from such de-icing salts either applied directly to the surface of the structure as in the case of bridge decks and roadways, or brought in on automobiles as in the case of garages. Studies performed by the National Bureau of Standards on the corrosion of steel in concrete indicate that the corrosion products can occupy over 2.2 times the original volume of steel causing severe internal pressures up to 330 $Kg/cm^2$. These pressures result in the concrete spalling and cracking. Where corrosion cells are provided on the reinforcing steel, high chloride ion concentration in the concrete deck or floor slab results in depolarization of the corrosion cells, produces an increased corrosion rate.

To fight this corrosion problem, there are generally three choices. The first is to coat the surface of the structure or deck to minimize penetration by the salts. The second is to modify the concrete to make it more resistant to chloride penetration, and the third is to permit the chloride penetration of the concrete but protect the steel as, for example, by cathodic protection.

The first two methods outlined above have many drawbacks and are not always available in existing structures. Both overlays and modification of the concrete are expensive. Coatings or overlays simply preclude further chloride penetration and if they are of any thickness they can create deadload problems. One of the principal drawbacks of overlays or coatings is that they preclude further visual inspection of the surface. In the area of protecting the steel itself, for new structures, coated or galvanized reinforcing bars may be employed. Coated reinforcing bar, while useful in new structures, is useful in existing structures only with substantial reconstruction.

Cathodic protection has been used for many years to combat corrosion of buried pipelines and structures in salt water environments. It has only recently been utilized in reinforced concrete structures.

In steel reinforced concrete structures, it is recognized that steel corrosion is the result of an electrical current flowing from one point on the steel to another. Such corrosion current is simply enhanced by moisture and salt contamination. If the flow of current is interrupted, the corrosion stops. Cathodic protection applies an external direct current to the steel in sufficient quantity to reverse or counteract the corrosive current.

To applicant's knowledge, prior cathodic protection systems for steel reinforced concrete decks or structures have utilized small point or pancake type anodes of either high silicon cast iron such as Durion, or graphite anode material. Pancake anodes, for example, are disc shape approximately 30.48 cm. in diameter and approximately 3.81 cm. thick. The leads or connections to the anodes extend centrally through the peripheral wall or edge and are tinned into a cored hole approximately 7.5 cm deep. Such anodes are typically strategically placed on the deck and may be secured thereto by epoxy cement. They are then generally covered by a conductive overlay, consisting of a 15 to 25% asphaltic material mixed with approximately 75 to 85% coke breeze material. The purpose of the conductive overlay is to distribute the current discharge from the anode out over the entire deck or bridge surface area and then to cause it to flow evenly down through the concrete to the reinforcing rod or steel to eliminate the corrosion on the steel. Typically, an additional asphaltic overlay is employed as a traffic wear surface. Accordingly, the entire overlay may typically be 5 or more centimeters in thickness. Such previous systems, although quite expensive, are in some cases suitable but do in many cases create problems.

For example, the conductive overlay must be put on in a relatively thick layer which adds a considerable deadload to the structure. In many cases, this additional weight may exceed the design limitations of the structure making the approach either impractical or causing reduced loading. In addition, as indicated above, an overlay precludes further visual inspection of the top surface of the deck or structure.

The small point or pancake type anodes employed which themselves have a fairly high corrosion rate, are of a fairly brittle material which when subjected to the traffic loads through the relatively soft overlays are subject to cracking or breakage during the life of the system. Also, the plastic insulated lead wires and their connection to the fragile anodes are particularly susceptible to shear breakage and to wear damage. The plastic insulated lead wires used to connect the anodes to the DC power supplies are often damaged in installation when the overlay is installed since the overlay is applied at a very hot temperature, 176° C. or higher being typical. Moreover, in a typical system, such pancake or point type anodes are generally zoned with the anodes in each zone being connected in series. Thus not only is an inordinate length of lead wire required, but each anode usually has two connections thus increasing the susceptibility to failure.

SUMMARY OF THE INVENTION

The apparatus and method of the present invention utilizes a highly flexible, platinized wire as the anode of the rigid or brittle point or pancake type anodes used heretofore. The wire anode can either be installed directly in the conductive asphaltic coke breeze mixture overlay or, preferably, it can be inserted into a slot cut directly into the concrete surface. The slot may typically be 1.9 cm. wide by 2.54 to 3.16 cm. deep.

A slot as described in the deck or top surface of a concrete structure may expose reinforcing bar or underlying steel. In such case, a plastic sleeve is placed over the elongated wire anode to reduce the possibility of shortcircuit or poor current distribution to the underlying reinforcing rod or steel. The anode is placed in the slot and surrounded by a carbonaceous or other highly conductive backfill. Preformed spacers of such conductive material may be used to locate the anode in the slot properly centered or positioned.

The wire or rod elongate anode may be terminated within the slot and spliced to an insulated copper lead wire or it may easily be brought down through the deck of the structure where the splice can be made in a convenient open area beneath the deck and thus out of the wear or traffic path. It may also be brought back to the deck edge, again out of the wear or traffic pattern, in a continuation of the slot with a plastic insulating tube over that portion of the anode not designed to operate as such.

Before the placement of the anode and the back fill, a plastic tape may be installed in the bottom of the slot to help improve current distribution. After the anode and back fill are installed, a tape barrier over the top of the conductive packed material may also be used followed by a top epoxy or urethane seal.

The use of the slot also facilitates the use of a water drip feed. Most decks or surfaces are intentionally sloped for drainage purposes and each slot will normally have a high end and a low end. Sometimes, the effectiveness of the cathodic protection current is altered by a drying out of the environment around the anode. Water is a polarized molecule and tends to move toward the cathode and away from the anode in a process known as electroend osmosis. If this presents a problem then a water drip feed at the high end of the slot maintaining a controlled moisture content around the anode may be employed. Obviously, a water drip feed would not be practical in a complete overlay system.

It is accordingly a principal object of the present invention to provide a cathodic protection system and method for reinforced concrete structures which is less expensive to install, longer lasting and more reliable.

Another important object is the provision of such system and method which is less subject to failure both upon installation and as the result of traffic wear.

Still another important object is the provision of such system and method which does not require heavy or thick overlays adding to the dead weight of the structure and precluding visual inspection of the surface.

A most important object is the provision of such system and method which obtains more uniform and efficient current distribution than that obtained from point source or pancake anodes.

Another object is the provision of such system and method which requires shorter leads, fewer connections, and which readily enables the leads to be connected both to the anode and to the rectifier away from traffic patterns and away from salt contamination.

Still another object is the provision of such system and method which can be used with or without reference electrodes.

Yet another object is the provision of such system and method which can be more readily inspected, serviced, repaired, and maintained.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

DETAILED DESCRIPTION OF THE INVENTION

Figure 1:
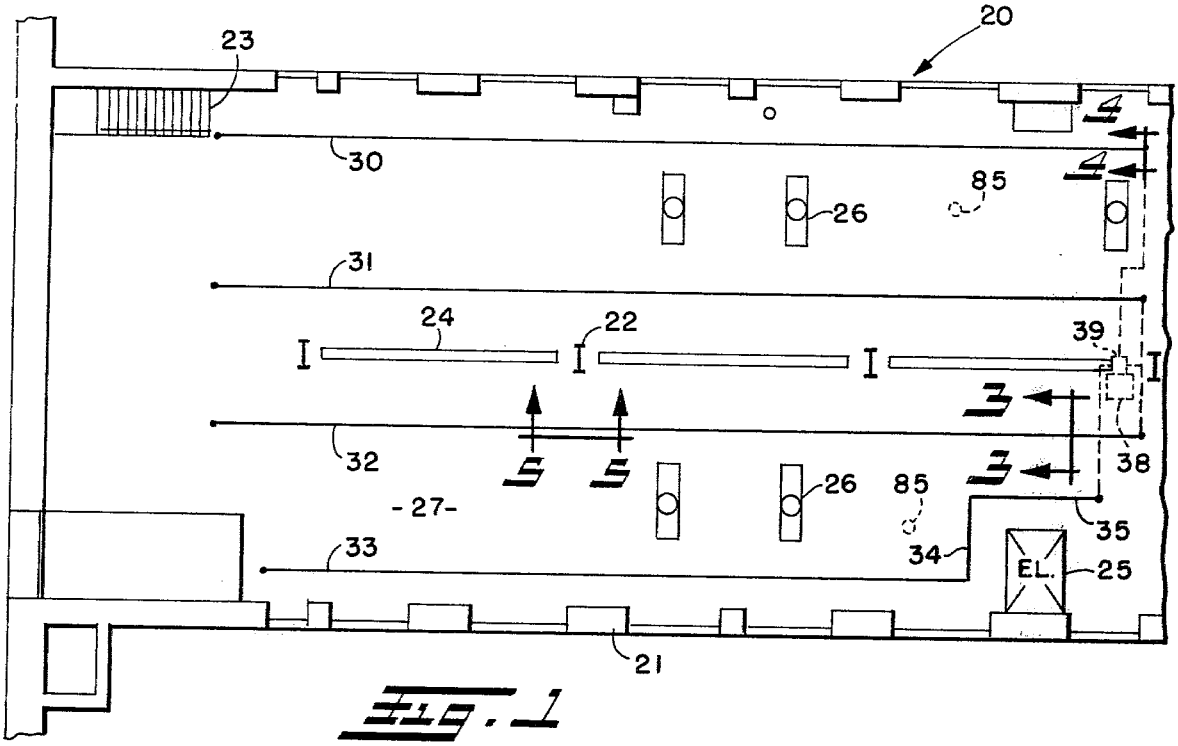
FIG. 1 is a fragmentary top plan view of a typical reinforced concrete structure illustrating typical strategic locations for the anodes with respect to the deck of the structure.

Referring now more particularly to the drawings and to FIG. 1 there is illustrated a concrete structure 20 which as illustrated may be a service garage for a tire or large department store. The structure includes a peripheral wall 21, center steel columns 22, a stairwell 23, partitions 24, an elevator 25, metal structure such as vehicle lifts 26, and, most importantly, a reinforced concrete deck or slab 27.

FIG. 1 also illustrates the placement of the anodes in accordance with the present invention. For example, FIG. 1 illustrates the placement of four anodes seen at 30, 31, 32 and 33. Because of the elevator 25 the anode 33 includes a portion 34 extending normal thereto and a further end portion 35 extending parallel to the major extent of the anode and to the other anodes. The illustrated anodes may each comprise a separate anode circuit and may be powered by a single constant current rectifier indicated at 38. The rectifier 38 and its junction box 39 may preferably be in the basement or floor below the slab or deck 27. In any event, the junction box and rectifier are out of the traffic or wear pattern for the deck above.

The location and spacing of the anodes may be determined by an engineering or electrical survey taking into account the structure, the metal in the structure, areas of corrosion, and nearby metal structures such as the elevator and the lifts. For example, the anode circuit 30 may be spaced approximately 1.52 meters from the exterior wall. The anode circuit 31 may be spaced approximately 4.28 meters from the anode circuit 30. The anode circuit 32 may be spaced approximately 2.13 meters from the partition 24 or columms 21. The anode circuits 32 and 33 may be spaced approximately 4.28 meters apart and the anode circuit 33 may be spaced approximately 1.52 meters from the exterior wall.

Figure 2:
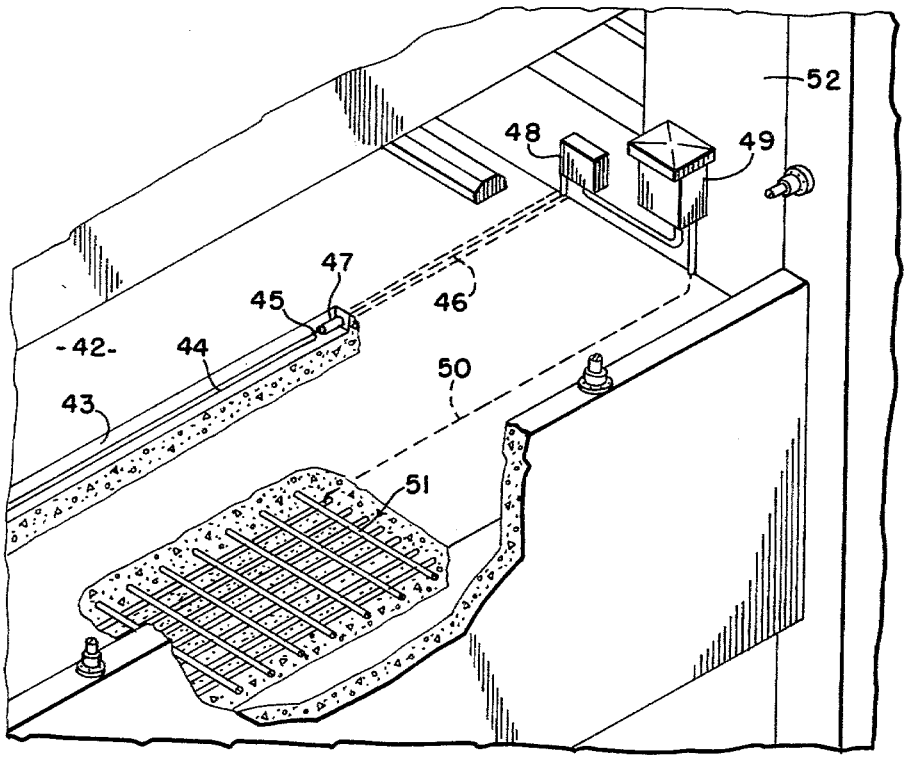
FIG. 2 is an enlarged fragmentary isometric of the structure partially broken away and in section illustrating the slot, the anode, the connection from the anode to a junction box, the rectifier, and the connection from the rectifier to the steel of the structure.

Referring now to FIG. 2, there is illustrated another similar type of structure showing the electrical connections between the anode, the junction box, the rectifier, and the metal structure of the slab or deck being protected. The deck 42 is provided with slots 43, hereinafter described, in which the anode 44 is situated. The anode 44 is electrically connected at 45 to a copper lead wire 46 which is encased in a plastic insulating tube 47. The lead wire and its tube are embedded in the deck and extend to a junction box 48. The junction box is electrically connected to the rectifer 49 which is in turn electrically connected at 50 to the reinforcing steel 51 for the deck 42. As indicated, both the junction box and rectifier are mounted out of the traffic pattern of the deck on the wall or column 52 of the structure. They could as easily be counted below the deck 42 but are convenient for access and servicing.

Figure 3:
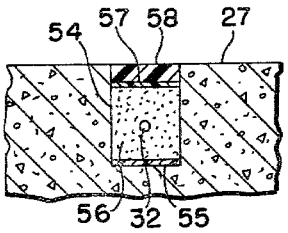
FIG. 3 is an enlarged fragmentary vertical section taken through the slot and anode as seen from the line 3—3 of FIG. 1.

Referring now to FIG. 3, to install the anode 32 in the deck 27, a slot 54 is saw cut into the top of the deck. The slot 54 may preferably be constructed by two parallel saw cuts with the portion therebetween chipped or broken out. As indicated, the slot may typically be 1.9 cm. wide and approximately 2.5 to 3.2 cm. deep. After the slot is formed and cleaned out, the bottom of the slot is covered by a plastic tape indicated generally at 55. The slot is then filled with a conductive carbonaceous back fill indicated at 56 to the approximate desired level of the anode 32. The selected length of anode material is then run through a straightener and layed centrally in the slot on the conductive carbonaceous material previously placed in the slot. When the anode is placed and electrically conducted to the lead wire as hereinafter described, the balance of the slot is filled with the conductive carbonaceous back fill material which is then covered with a further plastic tape 57. It is noted that the tape 57 is still below the top surface of the slot and the balance of the slot or approximately 6.35 mm. may be filled to a substantially flush condition with an elastomeric or plastic sealant such as epoxy or polyurethane as indicated at 58.

Figure 4:
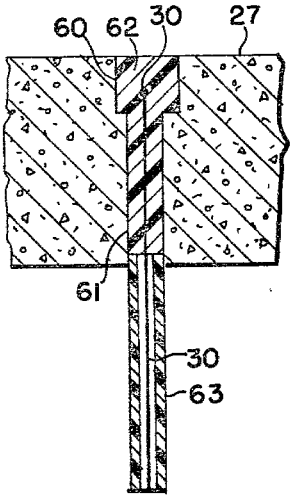
FIG. 4 is a fragmentary vertical section taken from substantially the line 4—4 of FIG. 1 showing the manner in which an anode may be connected to a lead wire through a hole drilled in the slab.

As seen in FIG. 4, the end of the slot 60 for the anode 30 may be provided with a drilled hole 61 extending vertically entirely through the deck or slab 27. The drilled hole 61 may have a diameter approximately 3.18 mm. and at the end of the slot may be filled with the elastomeric or plastic composition sealant 62 such as the aforementioned epoxy or polyurethane. The anode wire itself may extend downwardly through the hole and through plastic conduit 63 directly to the junction box or it may be connected to a copper lead wire for connection to the junction box. The conduit 63 is inserted in the lower end of the drilled hole and may be heat shrunk in effect to encapsulate the anode or the copper lead wire employed.

Figure 5:
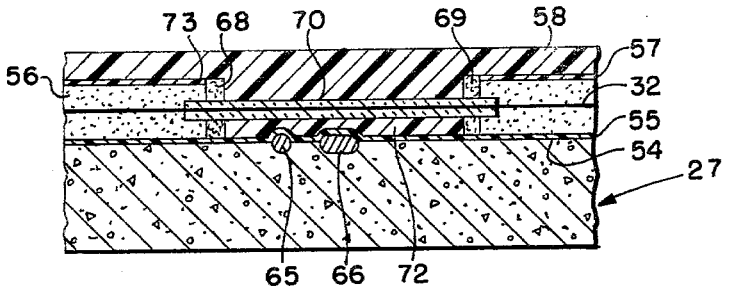
FIG. 5 is a fragmentary vertical section taken substantially on the line 5—5 of FIG. 1 illustrating the construction of the slot and anode where the slot may expose reinforcing steel.

Referring now to FIG. 5, when forming the slot 54, care should be taken to examine the bottom of the slot for exposed reinforcing steel such as seen at 65 and 66 in FIG. 5. With reinforcing steel, as indicated, close to the surface of the slab, it is important that care be taken to locate such exposed steel and to modify the construction of the slot and anode at that location. Otherwise, a short or very poor current distribution may result.

At such area of exposed reinforcing bar the conductive carbonaceous back fill 56 is terminated or interrupted by two dams seen at 68 and 69 through and between which extends a plastic insultating tube 70 through which the anode wire 32 extends. The tube 70 may be approximately 12.7 mm. in diameter. The dams 68 and 69 may be prefabricated, for ease of installation, if desired, or they may be an elastomeric composition having a consistency something like putty. The top sealant layer 58 as indicated at 72 extends completely around the tube 70 and thus the anode. The tape 54 of course also separates the exposed steel from the sealant 58. In this manner, any possibility of shorting is avoided and improved current throw or distribution is obtained. The tape 57 over the top of the carbonaceous conductive back fill 56 terminates at the dams as indicated at 73.

Dams such as seen at 68 and 69 may also be employed at the connection ends of the anodes to form a barrier between the conductive carbonaceous back fill and the sealant 62 as seen in FIG. 4.

Figure 6:
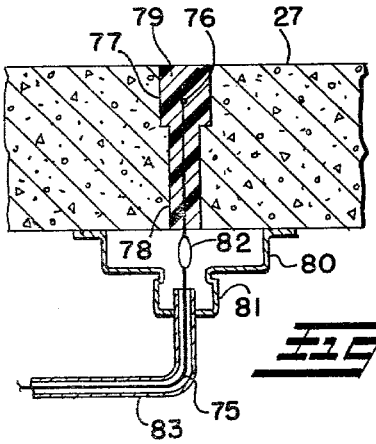
FIG. 6 is a fragmentary vertical section through the end of an anode illustrating how the anode may be brought through a drilled hole in the slab to a junction box beneath the slab.

Referring now to FIG. 6, there is illustrated a connection between a copper lead 75 and the anode wire 76, the latter being positioned in a slot 77 as in FIG. 3. At the end of the slot a vertical hole approximately 3.16 mm. is drilled as seen at 78 with the anode wire extending downwardly therethrough and sealed by the epoxy or polyurethane sealant as seen at 79. A junction box 80 is secured to the underside of the slab and may be provided with a removable cap 81. A taped compression splice 82 is provided in the junction box between the anode wire 76 and the copper lead 75 which extends through a conduit 83 to the junction box adjacent the rectifier.

Figure 7:
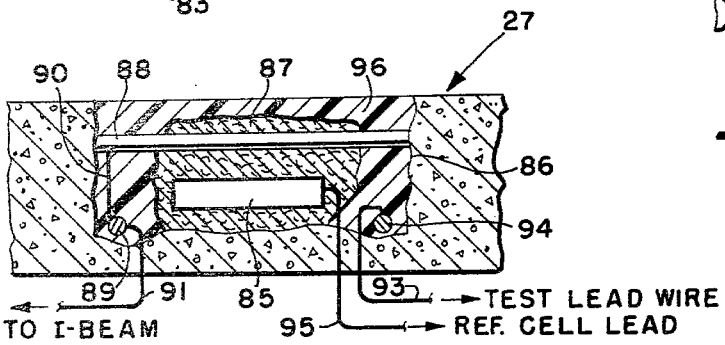
FIG. 7 is a fragmentary vertical section illustrating how a reference electrode may be installed if desired.

Referring now to FIG. 7, for test and evaluation purposes, if desired, silver/silver chloride reference electrodes or cells seen at 85 may be installed in the slab 27 at certain strategic locations as seen in FIG. 1. However, with a properly installed constant current system, the cost of installing the silver/silver chloride reference cells may not be warranted.

If installed, the concrete slab 27 may be chipped away as indicated at 86 to create a void in which the reference cell 85 is situated. The reference cell is surrounded by a suitable conductive back fill as indicated at 87. In such void, the upper layer of reinforcing bar seen at 88 is electrically connected to the lower reinforcing bar 89 and leads 90 and 91 interconnecting such bar may be grounded to a portion of the steel of the concrete structure such as an I-beam. The leads 90 and 91 may be connected to the reinforcing bar by a THERMITE, braze or mechanical connection coated with a bituminous compound.

A test lead 93 is connected to the reinforcing bar 94. The test lead 93 as well as the reference cell lead 95 may be connected to a test station, which may, for example, be mounted on the nearest center column in the basement. After the reference cell is installed and a minimum of 25.4 mm. of the conductive back fill is installed completely around the electrode 85, the back fill and the electrode are surrounded by a dielectric epoxy or polyurethane patch 96. If epoxy is employed, the patch should be made within thirty minutes of installing the back fill.

Again, because of the cost involved, the installation of the reference cells may not be warranted. It has been found that removable inserts used for making potential measurements through the epoxy patch or coating, at the surface of the slab, may perform quite well thus obviating the cost of installing such cells.

Figure 8:
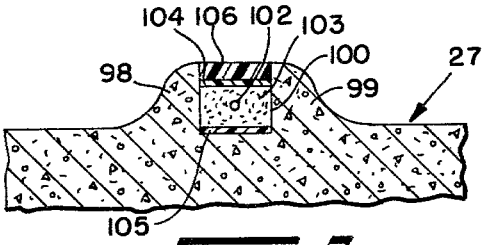
FIG. 8 is a fragmentary vertical section of another embodiment of the invention illustrating how the slot may be formed in a cast or built up portion of the deck of the structure.

It is of course desirable to make the slot in which the conductive back fill anode is situated as shallow as possible to avoid exposing reinforcing steel. In some situations, the slot may actually be cast on the surface of the slab as seen in FIG. 8. With special surface preparation, two elongated ridges 98 and 99 may be cast on the surface of the deck 27 forming the slot 100 therebetween. Special forms may be employed for casting the ridges in place with the slot being formed by a removable core. Special studs or anchors may be employed to ensure that the cast ridges are anchored to the slab surface. The anode 102 is then installed in the slot in the matrix of conductive carbonaceous back fill as seen at 103 between top and bottom plastic tapes 104 and 105. The top portion of the slot is then filled with the epoxy or polyurethane sealant as indicated at 106. If the anode containing ridge thus formed can be positioned out of the traffic pattern, so much the better. If it is positioned in the traffic pattern it is normally desirable to position it transversely of the traffic pattern and the ridge may then be used as a traffic slow-down bump commonly employed in parking lots and garages.

Figure 9:
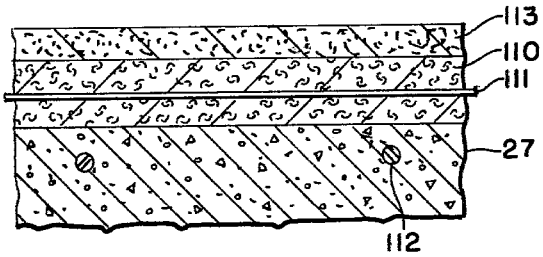
FIG. 9 is a fragmentary vertical section illustrating how, if desired, the anode system of the present invention may be installed in a complete overlay.

Although the slot arrangement is the preferred embodiment of the present invention, it will be appreciated that the wire type anodes, described more in detail below, could be situated in a conductive overlay seen at 110 in FIG. 9 covering the entire top surface of the slab 27. The anodes 111 would be positioned in the approximate middle of the thickness of the overlay 110. A top wear coating or membrane 113 is employed over the conductive back fill 110. The entire overlay embodiment of FIG. 9 can of course only be used where the dead loads permit. The use however of the wire type anode and its ease of connection does, however, provide certain advantages over the point source or pancake type anodes previously employed.

Figure 10:
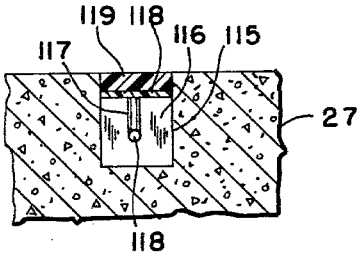
FIG. 10 is a fragmentary vertical section illustrating the use of preformed inserts which may be employed to support and locate the anode in the slot during installation.

Referring now to FIG. 10, a slot 115 is formed in the slab 27 as in FIG. 3. In the embodiment of FIG. 10 a tape need not be employed covering the bottom of the slot, except perhaps in situations where the reinforcing bar may be exposed as in FIG. 5. Before the conductive back fill is inserted into the slot, a plurality of anode holders such as seen at 116 may be inserted longitudinally spaced along the slot. Each of the holders is provided with a vertically extending slot 117 in the top thereof through which the anode 118 may be inserted. The holders may be formed, for example, of molded carbonaceous conductive material and assist in positioning the anode within the slot in the desired location prior to the insertion of the surrounding back fill. Once the conductive back fill is inserted, a tape may be positioned thereover as seen at 118 with the remainder of the slot then being filled with the epoxy or polyurethane sealant 119. Unlike the dams 68 and 69 in FIG. 5, the anode holders 116 of FIG. 10 may be of the same conductive material as the back fill. However, it will be appreciated that a non-conductive material may be employed if the wire holders are to be used as the dams in FIG. 5 with the anode extending through plastic tubing therebetween. The anode material of the present invention can of course be covered with plastic tubing such as the tubing 47 enclosing the lead 46 seen in FIG. 2 where current throw or distribution is not desired or required.

As a preferred anode, a platinized niobium or columbium wire is preferred. It will be appreciated that niobium and columbium are the same. Other platinum coated anodes such as titanium or tantalum may also be employed. Other suitable metals having the same passivating characteristics may also be employed. The above mentioned metals are very reactive metals and normally form an oxide coating which, but for the platinum coating, will not let the anodic current through. Such anode materials have a very low consumption rate. For example, approximately 0.006 grams are consumed for every ampere discharge per year. This compares with Durion where as much as a kilogram might be consumed in a year.

As far as the anode size is concerned, a preferred wire type anode might be approximately 1.6 mm. in diameter with a 1.25 micron platinum coating. The wire size might range as small as 1 mm. to approximately 4 to 5 mm. The anode also might be copper cored for better conductivity. A diameter of approximately 8 mm. would be perhaps the upper limit which perhaps approaches or overlaps rod sizes. The larger diameter wires or rods would of course be more expensive and have somewhat less flexibility than the smaller sizes, such flexibility being desirable for installation purposes.

It will also be appreciated that a wide variety of carbonaceous conductive back fills may be employed such as materials containing graphite, metallurgical grade coke, calcined fluid petroleum coke, calcined petroleum coke, and others.

Also, as indicated previously, the slot construction of the present invention facilitates the utilization of a water drip feed at the upper end of the slot. This eliminates the possibility of the anodic current drying out the environment around the anode which reduces the effectiveness of the cathodic protection.

Also, while it is preferred to employ a constant current SCR, it will be appreciated that other types of rectifiers may be employed such as a saturable reactor circuit. With a constant current rectifier, it will be appreciated that as resistant changes, perhaps due to moisture changes, a constant current rectifier automatically will sense the change and increase the circuit output voltage to maintain the current at a constant. Such rectifiers are available which may easily be zoned so that each anode circuit is provided with a different constant current level. An example of such a rectifier which may be used with the present invention is that sold under the trademark AUTO-AMP by Harco Corporation of Medina, Ohio.

The use of multiple anode circuits is of substantial benefit in analyzing the system performance. It is therefore desirable that as many individual circuits as practical should be employed.

While the use of a constant current rectifier is desirable, it may not be necessary. It has been found that the greatest protective current flow from the anodes occurs where the concrete is the most contaminated by salts. The salts reduce the resistivity of the concrete which therefore reduces the resistance through the concrete between the anode and the reinforcing steel. This effect, not only provides control of the protective current flow, but of course provides it where it is most needed.

It should also be understood that under certain circumstances it may be desirable to utilize an automatically controlled rectifier system which regulates its current output to maintain the reinforcing rod at a preselected protective potential level. Such rectifiers are available which may easily be zoned so that each anode circuit will maintain a different protective potential level. An example of such rectifier is that sold under the trademark TASC-V by Harco Corporation of Medina, Ohio.

Although in the illustrated embodiments, the slot or trough in the concrete is in the top of the slab, it will be appreciated that the slot or trough could easily be placed in the bottom of the slab, although installation would be more difficult. The components of the anode system would have to be troweled in place or held with suitable glues or sealants with an insured bond to the concrete.

As to the process steps of the present invention, the first step is to do a physical examination of the structure followed by an engineering study using design layouts noting the physical limitations, such as the elevators and lifts seen in FIG. 1. The engineering study accompanied by tests or surveys then usually results in a detailed design of the proposed system. After the location of the anodes is chosen, the grooves are cut by the double saw cut noted with the center chipped out. After the grooves are properly prepared, holes may be drilled at the ends of the grooves for the connections such as seen in FIGS. 4 and 6. A most important step then occurs which involves a very careful inspection of the bottom of the grooves and perhaps tests for exposed reinforcing rod. This permits such areas to be treated as in FIG. 5.

If there are no exposed rods, and it is known that the reinforcing steel is well spaced from the top surface of the slab, it may not be necessary to tape the entire bottom of the slot. Taping may be performed only in certain areas. It will also be appreciated that in lieu of the tape, a spray, calk or sealant may be employed.

The next step is to fill the slot with the conductive carbonaceous material approximately halfway and levelled. As indicated, the conductive material may include a wide variety of conductive carbon compounds or materials such as calcined petroleum coke, carbon black, ground or flake graphite, and the like.

The wire anode may be reeled off a spool and with the use of a "come-along" it may be stretched or straightened out to remove the memory from it. This straightening of the wire insures that it can be placed within the slot in the desired location. Alternatively, spacers such as shown in FIG. 10 may be employed before filling the slot with the conductive carbonaceous material.

After the wire is placed and properly connected or inserted through the vertical hole, the balance of the slot is filled with such material. After the wire is placed and the vertical hole sealed or provided with a dam or barrier, the balance of the slot is filled with the conductive carbonaceous material which may then be followed with a further tape and a topping of a sealant such as the aforementioned polyurethane, epoxy, or perhaps even a conventional sealant such as asphalt. The electrical connections such as seen in FIGS. 4 and 6 are made to the junction box, to the rectifier and from the rectifier to the steel of the structure. All of such connections may be out of the normal wear or load path imposed upon the electrode. If desired, reference cells may be installed as indicated in FIG. 7.

In any event it can be seen that there is provided a less costly, more efficient, easier to install and easier to maintain and service cathodic protection system for effectively protecting the steel in reinforced concrete structures. In addition to the above advantages, the anodes employed result in a longer lasting system which effectively substantially increases the life of such structures subject to chloride ion contamination.

Other modes of applying the principles of the invention may be employed, change being made as regards the details described, provided the features stated in any of the following claims or the equivalent of such be employed.

We claim:

1. A cathodic protection system for pre-existing steel reinforced concrete structures comprising a slot formed in the top concrete surface of such structure, a thin elongate corrosion resistant, metal anode juxtaposed to the concrete of the structure in such slot and electrically spaced from the steel of the structure, said anode being surrounded by a matrix of conductive carbonaceous backfill material, and a power source impressing a current between the anode and the steel.

2. A system as set forth in claim 1 wherein said anode and matrix is positioned in such slot which is saw-cut in a top concrete surface of said structure.

3. A system as set forth in claim 2 wherein said slot is filled with conductive carbonaceous material to form said matrix and said anode is in the approximate center thereof.

4. A system as set forth in claim 2 wherein said anode is insulated in areas where reinforcing steel may be exposed by said slot.

5. A system as set forth in claim 2 wherein said matrix is interrupted in areas where reinforcing steel may be exposed by said slot.

6. A system as set forth in claim 2 wherein said anode is insulated and said matrix interrupted in areas where reinforcing steel may be exposed by said slot.

7. A system as set forth in claim 2 wherein said matrix is covered with plastic tape.

8. A system as set forth in claim 2 wherein said matrix is enclosed top and bottom by plastic tape.

9. A system as set forth in claim 2 wherein said matrix is covered by a wear resistant sealant to bring the contents of the slot substantially flush with the surface of the structure.

10. A system as set forth in claim 2 wherein said slot is formed by adding to the surface of said structure.

11. A system as set forth in claim 2 wherein said structure is a reinforced concrete slab, and a hole drilled in the end of said slot to extend through said slab, said anode extending through said hole so that the electrical connection thereto is beneath said slab.

12. A system as set forth in claim 11 including a junction box on the underside of said slab, and a copper lead connected to said anode in said junction box.

13. A system as set forth in claim 11 wherein said hole is filled with a plastic or elastomeric sealant.

14. A system as set forth in claim 1 wherein said anode is a thin wire of a platinum coated reactive metal.

15. A system as set forth in claim 14 wherein said reactive metal is selected from the group of columbium, titanium or tantalum.

16. A system as set forth in claim 15 wherein said thin wire is copper-cored.

17. A system as set forth in claim 1 wherein the principal ingredient of said carbonaceous material is selected from the group consisting of graphite, coke breeze, metallurgical coke, calcined fluid petroleum coke, or calcined petroleum coke.

18. A method of cathodically protecting a pre-existing metal reinforced concrete structure comprising the steps of strategically positioning slots near the top surface of the structure, positioning elongated corrosion resistant, metal wire or rod anodes adjacent the concrete in such slots in a matrix of carbonaceous backfill material, and impressing a protective current flow from the anodes.

19. A method as set forth in claim 18 including the step of saw-culting a slot in a top surface of the concrete and positioning said anode and the matrix in such slot.

20. A method as set forth in claim 19 including sealing the slot substantially flush with the surface of the concrete.

21. A method as set forth in claim 19 wherein the slot is formed by parallel saw cuts with the area therebetween broken out.

22. A method as set forth in claim 19 wherein the slot is formed by adding concrete to the surface of the structure.

23. A method as set forth in claim 19 including the step of drilling a hole in the end of the slot, and extending the anode through the hole.

24. A method as set forth in claim 23 including the step of electrically connecting the anode to a lead at the end of the hole opposite the slot.

25. A method as set forth in claim 23 including the step of sealing the hole.

26. A method as set forth in claim 19 including the step of carefully inspecting the slot after forming for exposed reinforcing metal, and in the area of any exposed metal insulating the anode and interrupting the matrix.

27. A method as set forth in claim 26 wherein the step of insulating the anode includes placing plastic tape over the exposed metal, and surrounding the anode with a dielectric sealant.

28. A method as set forth in claim 27 including the step of enclosing the anode in a plastic tube and surrounding the tube with such dielectric sealant.

29. A method as set forth in claim 19 wherein the matrix includes plastic tape confining the top and bottom thereof with a sealant thereover.

30. A method as set forth in claim 18 wherein the anode is a wire of platinum coated reactive metal.

31. A method as set forth in claim 30 wherein the reactive metal is selected from the group consisting of columbium, titanium or tantalum.

32. A method as set forth in claim 31 wherein the wire is straightened before being placed in the matrix.

33. A method as set forth in claim 31 wherein said wire is copper-cored.

34. A method as set forth in claim 18 wherein the matrix includes a conductive ingredient selected from the group consisting of coke breeze, graphite, metallurgical coke, calcined fluid petroleum coke, or calcined petroleum coke.

* * * * *

UNITED STATES PATENT AND TRADEMARK OFFICE

CERTIFICATE OF CORRECTION

PATENT NO. : 4,255,241

DATED : March 10, 1981

INVENTOR(S) : Kroon et al

It is certified that error appears in the above—identified patent and that said Letters Patent is hereby corrected as shown below:

Cover page, under Attorney, Agent, or Firm the name should be changed from "Jones, Thomas & Askew" to --Maky, Renner, Otto & Boisselle--.

Under Summary of the Invention, column 2, line 2, after "anode", please insert --instead--.

Signed and Sealed this

Ninth Day of June 1981

[SEAL]

*Attest:*

RENE D. TEGTMEYER

*Attesting Officer*

*Acting Commissioner of Patents and Trademarks*